US006289980B1

(12) United States Patent
Insalaco et al.

(10) Patent No.: US 6,289,980 B1
(45) Date of Patent: Sep. 18, 2001

(54) BAFFLE FOR HEAT EXCHANGER MANIFOLD

(75) Inventors: Jeffrey Lee Insalaco; Cowley Wendell Phillips, Jr., both of Brandon, MS (US)

(73) Assignee: Norsk Hydro, A.S., Oslo (NO)

( * ) Notice: Subject to any disclaimer, the term of this patent is extended or adjusted under 35 U.S.C. 154(b) by 0 days.

(21) Appl. No.: 09/464,927

(22) Filed: Dec. 16, 1999

(51) Int. Cl.[7] ..... F28F 9/22
(52) U.S. Cl. ..... 165/174; 165/176
(58) Field of Search ..... 165/174, 176; 228/135

(56) References Cited

U.S. PATENT DOCUMENTS

| | | | |
|---|---|---|---|
| Re. 35,742 | 3/1998 | Hoshino et al. . | |
| 4,825,941 | 5/1989 | Hoshino et al. . | |
| 4,960,169 | 10/1990 | Granetzke . | |
| 5,123,483 * | 6/1992 | Tokutake et al. | 165/174 X |
| 5,125,454 | 6/1992 | Creamer et al. . | |
| 5,207,738 | 5/1993 | Dey . | |
| 5,233,756 | 8/1993 | le Gauyer . | |
| 5,348,083 | 9/1994 | Hosoya et al. . | |
| 5,402,571 | 4/1995 | Hosoya et al. . | |
| 5,560,425 | 10/1996 | Sugawara et al. . | |
| 5,743,329 | 4/1998 | Damsohn et al. . | |

FOREIGN PATENT DOCUMENTS

| | | | |
|---|---|---|---|
| 5-272889 * | 10/1993 | (JP) | 165/174 |
| 7-17962 * | 4/1995 | (JP) | 165/174 |

* cited by examiner

*Primary Examiner*—Leonard Leo
(74) *Attorney, Agent, or Firm*—Gary M. Hartman; Domenica N. S. Hartman

(57) ABSTRACT

A heat exchanger baffle and method by which the internal passage of a heat exchanger member is divided into two separate flow regions. The baffle includes first and second members having planar portions that define edges of the first and second members. The planar portions are connected to each other so as to form a connection region between the first and second members. The connection region is deformable to enable the planar portions to be folded onto each other. The baffle can then be installed in a heat exchanger member by installing the planar portions together into a slot in the wall of the heat exchanger member. After installation, the planar members remain substantially parallel to each other, and the connection region preferably contacts a portion of the wall opposite the slot. The manner in which the baffle is folded serves to bias the first and second members against the slot, so that the baffle is more reliably retained within the slot prior to being permanently secured by such methods as brazing. Each member of the baffle also preferably has a flange and a raised region within its planar portion. When the baffle is installed in the heat exchanger member, a portion of the wall is engaged by and between the raised region and the flange of each member, so that the baffle is securely retained within the slot prior to being permanently secured by brazing.

8 Claims, 1 Drawing Sheet

BAFFLE FOR HEAT EXCHANGER MANIFOLD

BACKGROUND OF THE INVENTION

1. Field of the Invention

The present invention generally relates to heat exchanger construction and assembly methods. More particularly, this invention relates to a baffle and method for creating at least two isolated fluid circuits within a heat exchanger.

2. Description of the Prior Art

Baffles are used in a variety of applications to block and direct the flow of fluids and gases through tubular members, such as a manifold of a heat exchanger. Heat exchangers typically include tubes interconnected between a pair of manifolds. To optimize heat transfer efficiency, the flow of a heat transfer fluid (gas or liquid) through the tubes is often controlled by placing baffles at certain points within the manifolds, such that separate and parallel flow regions can be established within the heat exchanger by appropriately routing the fluid through its tubes.

The prior art has suggested various baffle designs and methods for installing baffles within heat exchanger manifolds. One example is to use cup-shaped baffles that are installed within the internal passage of a manifold and then brazed in place. Brazing is desirable for forming a high-strength, fluid-tight seal with a baffle, particularly if the heat exchanger has a brazed construction. However, a difficulty with cup-shaped baffles is that braze flux may remain trapped within the manifold, which can corrode the interior of the heat exchanger. Another approach is the use of partitioning plates inserted through circumferential slots formed in the wall of a heat exchanger manifold. Examples of partitioning plates known in the art are disclosed in U.S. Pat. Nos. 4,825,941, 5,125,454, 5,348,083, 5,743,329 and U.S. Pat. No. Re. 35,742. Though the slots can facilitate removal of residual braze flux from the manifold, they can substantially weaken the manifold wall, reducing its capacity to withstand numerous temperature and pressure cycles. In addition, partition plates of the prior art are prone to being dislodged prior to being brazed to the manifold, such that leaks between flow regions can occur through a gap between the plate and manifold wall.

In view of the above, it would be desirable if an improved baffle design were available that avoided or minimized the shortcomings of the prior art, including the concerns for flux contamination, reduced wall strength and the likelihood of leaks.

SUMMARY OF THE INVENTION

The present invention provides a heat exchanger baffle and method by which the internal passage of a heat exchanger member is divided into two separate flow regions within the passage. The baffle includes first and second members having planar portions that define edges of the first and second members. The planar portions are connected to each other so as to form a connection region between the first and second members. The connection region is deformable to enable the planar portions to be folded onto each other. The baffle can then be installed in a heat exchanger member by installing the planar portions together into a slot in the wall of the heat exchanger member. After installation, the planar members remain substantially parallel to each other, and the connection region preferably contacts a portion of the wall opposite the slot. The manner in which the baffle is folded serves to bias the first and second members against the slot, so that the baffle is more reliably retained within the slot prior to being permanently secured by such methods as brazing.

Each member of the baffle preferably has a flange that projects substantially perpendicular to the planar portion of the member. At least a portion of the flange is oppositely disposed from the connection region, so that the planar portion of the member is between the flange and the connection region. When the connection region is bent to install the baffle, the flanges of the first and second members preferably project in substantially opposite directions relative to each other, and each preferably abuts the external surface of the wall so that the wall around the slot is reinforced by the flanges. Each member of the baffle also preferably has a raised region within its planar portion. When the baffle is installed in the heat exchanger member, a portion of the wall is engaged by and between the raised region and the flange of each member as a result of the baffle being folded and the first and second members being biased against the slot. In this manner, the baffle is securely retained within the slot prior to being permanently secured by brazing.

In view of the above, it can be seen that the baffle of this invention is configured to be more reliably retained in the manifold wall slot prior to being permanently attached to the manifold. Furthermore, the flanges are able to compensate the manifold wall for strength lost as a result of the slot formed in the wall.

Other objects and advantages of this invention will be better appreciated from the following detailed description.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 3:
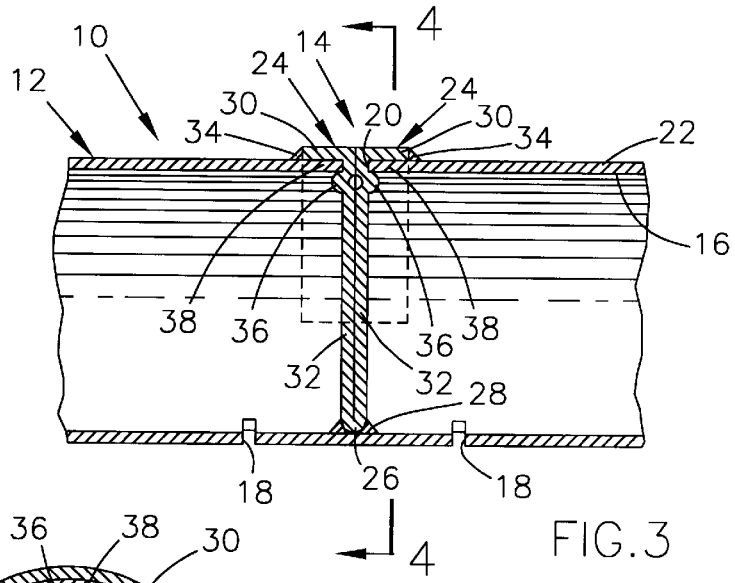
FIGS. 3 and 4 are longitudinal and diametrical cross-sections of a heat exchanger manifold in which the baffle of FIGS. 1 and 2 has been installed in accordance with this invention.

Shown in cross-section in FIG. 3 is a portion of a heat exchanger unit 10, including a manifold 12 and a baffle 14. The baffle 14 is shown as separating the internal passage 16 of the manifold 12 into two flow regions, as is desired for many heat exchanger applications. Tube slots 18 are shown along the lower perimeter of the manifold 12 through which cooling tubes (not shown) would be inserted and brazed in place to carry fluid for one of the flow regions defined by the baffle 14. A second manifold would be conventionally assembled to the opposite ends of the tubes to complete the unit 10. The manifold 12 is shown as being a seam-welded tube with a round cross-section. For various reasons known in the art, the manifold 12 and tubes are preferably formed of an aluminum alloy clad with an aluminum-silicon eutectic brazing alloy, such as AA 4045, AA 4047 and AA 4343 aluminum alloys (AA being the designation given by the Aluminum Association). These silicon-rich braze alloys have a lower melting temperature than the base aluminum alloy, which is often AA 3003, having a nominal chemistry of about 1.2 weight percent manganese, with the balance being substantially aluminum. A sufficient amount of braze alloy is provided by the cladding layer to form fluid-tight brazements when the assembled manifold 12, baffle 14 and tubes are heated to a temperature above the melting temperature of the cladding, but below the melting temperature of the base aluminum alloy. Those skilled in the art will appreciate that a wide variety of different manifold configurations are possible with this invention, and may differ considerably from that shown in FIG. 3.

Figure 4:
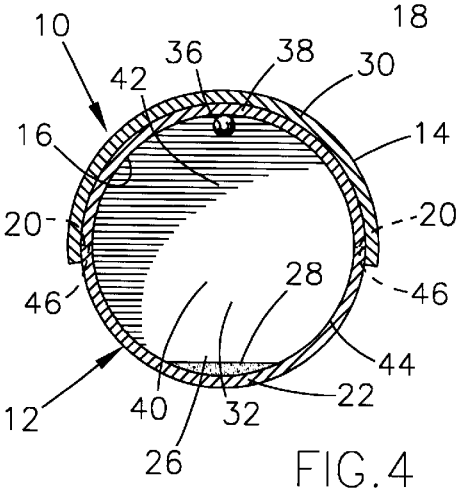

The baffle 14 is shown in FIG. 3 as being installed in a slot 20 formed in the wall 22 of the manifold 12 opposite the tube slots 18. As depicted in FIG. 4, the slot 20 preferably extends through half the circumference of the manifold 12. When installed, the baffle 14 has a folded configuration, with two members 24 attached by what will be termed a connection region 26, which is bent sharply as seen in FIG. 3 so that the portion of the baffle within the passage 16 is generally V-shaped. The connection 26 region 26 contacts the wall 22 of the manifold 12 between an adjacent pair of tube slots 18, and is secured with a brazement 28 to form a fluid-tight joint. Opposite the connection region 26 are a pair of flanges 30, one on each member 24. Each flange 30 is approximately perpendicular to a planar region 32 of its member 24, which primarily defines that portion of each member 24 within the internal passage 16 of the manifold 12. The flanges 30 project in opposite directions, contacting the exterior surface of the manifold 12 on opposite sides of the slot 20. The flanges 30 are shown as being joined to the manifold wall 22 with brazements 34, providing for a significantly reinforced wall 22 surrounding the slot 20. Finally, each member 24 has a raised projection 36 protruding from its planar portion 32 in the same direction as its flange 30. The circumferential rim 38 of the wall 22 formed by the slot 20 is shown as being trapped between the flange 30 and projection 36 of each member 24, which enables the baffle 14 to be temporarily secured within the slot 20 prior to being permanently secured by brazing.

Figure 1:
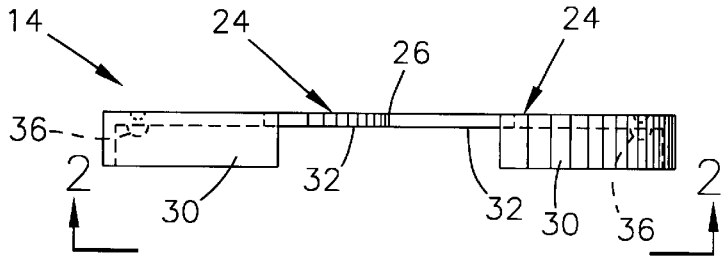
FIGS. 1 and 2 are cross-sectional and plan views, respectively, of a heat exchanger baffle in accordance with this invention.
Figure 2:
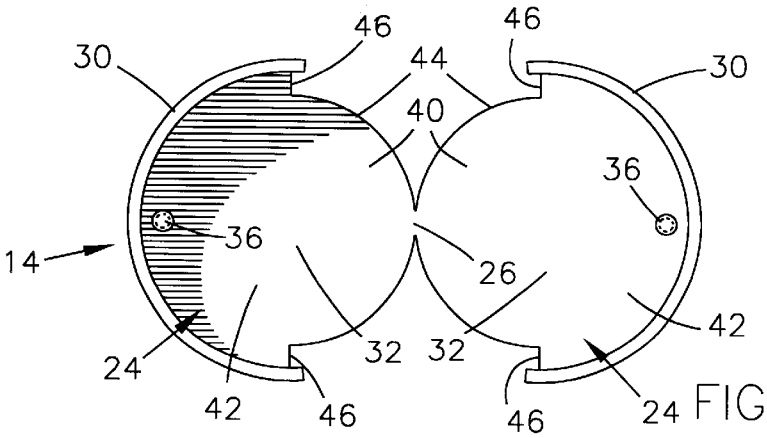

The baffle 14 is shown in FIGS. 1, 2 and 3 as basically having a symmetrical configuration, the connection region 26 being the axis of symmetry. For assembly with the round manifold 12 shown in FIGS. 3 and 4, the members 24 of the baffle 14 are shown in FIGS. 1 and 2 as being circular-shaped. The planar region 32 of each member 24 is generally composed of two semicircular regions 40 and 42, a first 40 of which defines a semicircular edge 44 of the member 24 while the second 42 is bordered by the flange 30, with a radial edge 46 interconnecting the semicircular edge 44 with the flange 30. The second semicircular region 42 has a greater radius than the first semicircular region 40, the difference being approximately equal to the thickness of the manifold wall 22 as shown in FIG. 4. The projection 36 of each member 24 is within the second semicircular region 42 and spaced a distance from the first semicircular region 40 a distance of less than the radius of the first semicircular region 40 so to be located within the internal surface of the wall 22 when the baffle 14 is installed. In addition, each projection 36 is spaced from its adjacent flange 30 a distance that is slightly less than the difference between the radii of the first and second semicircular regions 40 and 42, so as to create a slight interference with the rim 38 of the wall 22.

From FIG. 4, it can be seen that the preferred spacial arrangement of the structural features of the members 24 enables the edge 40 of each member 24 to either contact or be disposed immediately adjacent the wall 22 of the manifold 12 when the baffle 14 is installed through the slot 20. Furthermore, the placement of the projection 36 in the planar region 32 relative to the flange 30 and edge 40 enables the rim 38 of the manifold wall 22 surrounding the slot 20 to be held between the flange 30 and projection 36. Because the baffle 14 is folded, the members 24 are biased somewhat away from each other and against the slot 20, so that the baffle 14 is more reliably retained within the slot 20 prior to being permanently secured with the brazements 28 and 34. The radial edge 46 is shown as contacting or at least adjacent the longitudinal portion of the rim 38 of the wall 22, while the flange 30 circumferentially extends beyond the radial edge 46 so as to better seal the slot 20 with the brazement 34, and possibly provide an additional gripping action about the circumference of the manifold 12 to better retain the baffle 14 prior to brazing.

While the invention has been described in terms of a preferred embodiment, it is apparent that other forms could be adopted by one skilled in the art. Accordingly, the scope of the invention is to be limited only by the following claims.

What is claimed is:

1. A heat exchanger baffle comprising first and second members having planar portions that define edges of the first and second members, the planar portions being connected to each other so as to form a connection region between the first and second members, the connection region being deformable to enable the planar portions to be folded onto each other so as to be substantially parallel to each other when the connection region is sufficiently bent, each of the first and second members further comprising:

a first semicircular region formed by about one-half of the planar portion thereof, the first semicircular region defining a first semicircular edge having a first radius, the first semicircular edges of the first and second members contacting each other at the connection region;

a second semicircular region formed at least in part by the remainder of the planar portion thereof, the second semicircular region defining a second semicircular edge having a second radius that is greater than the first radius, the second semicircular edges of the first and second members being oppositely disposed from each other relative to the connection region;

radial edges connecting the first semicircular edge with the second semicircular edge; and a flange projecting substantially perpendicular to the planar portion, the flange being oppositely disposed from the connection region so that the planar portion is between the flange and the connection region, the flange circumferentially extending beyond the radial edge.

2. A heat exchanger baffle according to claim 1, wherein the connection region is bent so that the planar portions are not coplanar and define a V-shaped region of the baffle.

3. A heat exchanger baffle according to claim 1, wherein the connection region is bent so that the baffle is V-shaped.

4. A heat exchanger baffle according to claim 1, wherein the baffle is symmetrical about the connection region.

5. A heat exchanger baffle according to claim 1, wherein the first member further comprises a raised region projecting from the planar portion thereof within the second semicircular region thereof, the raised region being spaced a distance from the flange that is less than the difference between the first and second radii.

6. A heat exchanger member comprising:

a wall having an external surface and an internal surface defining an internal passage within the wall;

a slot through the wall;

a baffle received in the internal passage through the slot so as to divide the internal passage into two isolated flow regions, the baffle comprising first and second members having planar portions within the internal passage, the planar portions defining edges of the first and second members that abut the internal surface of the wall, the planar portions being connected to each other so as to form a connection region between the first and second members, the connection region being bent so that the planar portions are parallel to each other, the connection region contacting a portion of the wall opposite the slot, each of the first and second members further comprising:

a first semicircular region formed by about one-half of the planar portion thereof, the first semicircular region defining a first semicircular edge having a first radius, the first semicircular edges of the first and second members contacting each other at the connection region;

a second semicircular region formed at least in part by the remainder of the planar portion thereof, the second semicircular region defining a second semicircular edge having a second radius that is greater than the first radius, the second semicircular edges of the first and second members being oppositely disposed from each other relative to the connection region;

radial edges connecting the first semicircular edge with the second semicircular edge; and a flange projecting substantially perpendicular to the planar portion, the flange being oppositely disposed from the connection region so that the planar portion is between the flange and the connection region, the flange circumferentially extending beyond the radial edge.

7. A heat exchanger member according to claim 6, wherein the baffle is symmetrical about the connection region.

8. A heat exchanger member according to claim 6, wherein the first member further comprises a raised region projecting from the planar portion thereof within the second semicircular region thereof, a portion of the wall being engaged by and between the raised region and the flange.

* * * * *